United States Patent [19]

Hansel

[11] 4,040,448

[45] Aug. 9, 1977

[54] DISPENSER MEMBER FOR FILLING FLUID STORAGE CONTAINERS

[75] Inventor: William B. Hansel, Media, Pa.

[73] Assignee: Sun Oil Company of Pennsylvania, Philadelphia, Pa.

[21] Appl. No.: 623,190

[22] Filed: Oct. 16, 1975

Related U.S. Application Data

[60] Division of Ser. No. 511,821, Oct. 3, 1974, Pat. No. 3,946,758, which is a continuation-in-part of Ser. No. 214,872, Jan. 3, 1972, abandoned, and a continuation-in-part of Ser. No. 280,611, Aug. 14, 1972, abandoned.

[51] Int. Cl.[2] ..... F15D 1/02

[52] U.S. Cl. ..... 138/42; 138/40; 138/89; 138/178; 222/189; 222/464

[58] Field of Search ..... 138/40, 42, 89, 178; 215/305, 295, 296, 299, 300; 4/295; 222/189, 464

[56] References Cited

U.S. PATENT DOCUMENTS

| | | | |
|---|---|---|---|
| 350,350 | 10/1886 | Crump | 215/300 |
| 489,081 | 1/1893 | Lintz | 215/300 X |
| 877,805 | 9/1908 | Stillwater | 215/299 |
| 950,751 | 3/1910 | Kearney | 215/299 |
| 978,633 | 12/1910 | Ottowitz | 215/300 |
| 2,815,889 | 12/1957 | Stetz et al. | 138/42 X |
| 2,815,889 | 12/1957 | Stetz et al. | 222/464 X |
| 3,027,746 | 4/1962 | Kappel | 138/40 X |
| 3,291,342 | 12/1966 | Mankin | 222/189 X |
| 3,362,640 | 1/1968 | Fainman | 222/189 X |
| 3,501,067 | 3/1970 | Rigor | 222/464 |
| 3,711,259 | 1/1973 | Gurney | 138/42 X |

FOREIGN PATENT DOCUMENTS

| | | | |
|---|---|---|---|
| 324,828 | 8/1902 | France | 215/299 |
| 457,863 | 2/1949 | Italy | 215/300 |
| 19,834 | 6/1889 | United Kingdom | 215/299 |

*Primary Examiner*—Richard E. Aegerter
*Assistant Examiner*—James E. Bryant, III
*Attorney, Agent, or Firm*—J. Edward Hess; Donald R. Johnson; Paul Lipsitz

[57] ABSTRACT

A dispenser/diffuser member for filling storage containers for fluids, which is positioned between the inner end of the fill-pipe and the interior of the container to cause dispersion of the fluid flowing into the container from the fillpipe during a filling operation. The disperser member has therein a multiplicity of tortuous fluid passages, and may be used in a subterranean storage container, or in a mobile storage and transportation container (tank truck).

3 Claims, 3 Drawing Figures

DISPENSER MEMBER FOR FILLING FLUID STORAGE CONTAINERS

This is a division of application Ser. No. 511,821, filed Oct. 3, 1974 now U.S. Pat. No. 3,946,758, which application is a continuation-in-part of my prior application, Ser. No. 214,872, filed Jan. 3, 1972, now abandoned; and of Ser. No. 280,611, filed Aug. 14, 1972, now abandoned.

This invention relates to a dispenser/diffuser member used in filling arrangements for fluid storage containers, and in particular containers for the storage and/or transportation of hydrocarbons such as gasoline.

One of the problems facing the petroleum industry in its gasoline-marketing operations is contamination of gasoline by dirt and water. These foreign materials can cause both the service station operator and the motorist a great deal of trouble and inconvenience. Dirt can clog the small jets in modern carburetors and can also clog fuel line filters. Water can cause rust, corrosion, fuel line freezeups, and if it comes in slugs, can cause an engine to stop. This can lead to dollar cost liability borne by the oil company, for repairs, and also to loss of customer goodwill. Also, water may freeze in the service station gasoline pumps, which is a great inconvenience to the service station operator.

The problem of dirt has been attacked by installing filters, capable of removing very fine particles, ahead of the gasoline pump nozzle.

Reducing the water contamination is a much more difficult problem. Water gets into the fuel in service station storage tanks in many ways, some of which are: (1) the floating roofs on large storage tanks at the refinery may leak rain water, the water in these tanks then being conveyed by tank trucks to service stations and delivered into the service station storage tanks; (2) the "breathing" of service station storage tanks can cause water to condense in the tanks; (3) rain may leak into the fillpipes or vent tubes of service station storage tanks. As a result of the foregoing, there is commonly present, in the bottom of subterranean storage tanks used for the storage of liquid fuel, a layer of water.

Fillpipes for subterranean storage tanks customarily extend from the surface down through the interior of the tank, terminating a short distance (e.g., four inches) above the bottom of the tank. Assuming a fillpipe diameter of four inches (which is typical), and a delivery of 350 to 400 gallons per minute from a tank truck into the subterranean storage tank, during a filling operation the gasoline travels through the fillpipe at a linear velocity on the order of nine to ten feet per second, and issues with this velocity from the lower end of the fillpipe, close to the bottom of the tank. The falling fuel (falling down through the fillpipe), exiting from the end of the fillpipe at this high velocity and thus possessing a substantial amount of kinetic energy, stirs up the layer of water and dirt present at the bottom of the subterranean tank, causing these contaminants to become entrained in the fuel, and hence subject to being dispensed along with the fuel. Therefore, the problem of contamination (both by water and dirt) is particularly acute just after a load of gasoline is delivered into the service station storage tank.

An object of this invention is to provide an improved dispenser/diffuser member used in a filling arrangement for subterranean liquid fuel storage tanks.

Another object is to provide a dispenser/diffuser member useful in a filling arrangement for subterranean liquid fuel storage tanks characterized in that it functions to eliminate the mixing of water, dirt, etc. (present in the tank) with fuel during the tank-filling operation.

A further object is to provide a device of the aforesaid character which can be inserted into, or removed from, subterranean tanks in situ, by means operable from the surface. The ability to insert the device from the surface of the tank installation is of significant benefit since it eliminates the need for tank removal and costly modification to the tank and its reinstallation. Also, the ability to remove the device from the surface without the need to dig around the tank for access is of value when it is desired to remove the device for inspection or replacement.

A still further object is to provide a novel disperser/-diffuser member, for the fillpipes of subterranean storage tanks, which is rather inexpensive.

In the past, it was the usual practice to load tank trucks from the top, using a drop tube (fill line) extending into an open hatch. The operator, standing on the top of the truck, would watch the fuel rise in the tank truck comprising, shutting off a valve in the fill line when the compartment became full.

Today, by contrast, most oil companies are changing to bottom loading, wherein the fuel is pumped into the bottom of each tank truck compartment through a special, tight-fill connection. This change is being made for two reasons: (1) it removes the operator from his former, hazardous position at the top of the truck; (2) it facilitates the addition of a vapor recovery system, which will be mandatory in the near future. However, bottom loading does present a serious problem. During the bottom loading (container filling) operation, the fluid (i.e., the fuel) flows through the fluid flow conduit (fill line) at a rather high velocity, such that the fluid possesses a substantial amount of kinetic energy. The initial flow of fuel into the empty tank from the bottom is therefore quite violent, causing the fuel to squirt all over the tank and vaporizing a considerable quantity of it. This violent flow has been known to actually cause structural damage to the tank.

According to prior practice, this undesirable action has been at least partially obviated by utilizing a costly, two-speed control valve which operates to cut down the filling or loading rate until there is a head of liquid (fluid) present in the tank which is adequate to absorb the high kinetic energy of the fluid under high flow (full flow) conditions.

The various objects of this invention are accomplished, briefly, in the following manner: For filling various types of fluid storage containers with hydrocarbon fluids, a disperser/diffuser member, made from a material substantially unaffected by hydrocarbons and having therein a multiplicity of tortuous or labyrinthine fluid passages, is positioned in the fluid flow path between the filling conduit or fillpipe and the interior of the container. The disperser/diffuser member may be used, for example, in conjunction with the fillpipe in a subterranean storage tank, or it may be used in a bottom loading arrangement for a tank truck.

A detailed description of the invention follows, taken in conjunction with the accompanying drawings, wherein.

Figure 1:
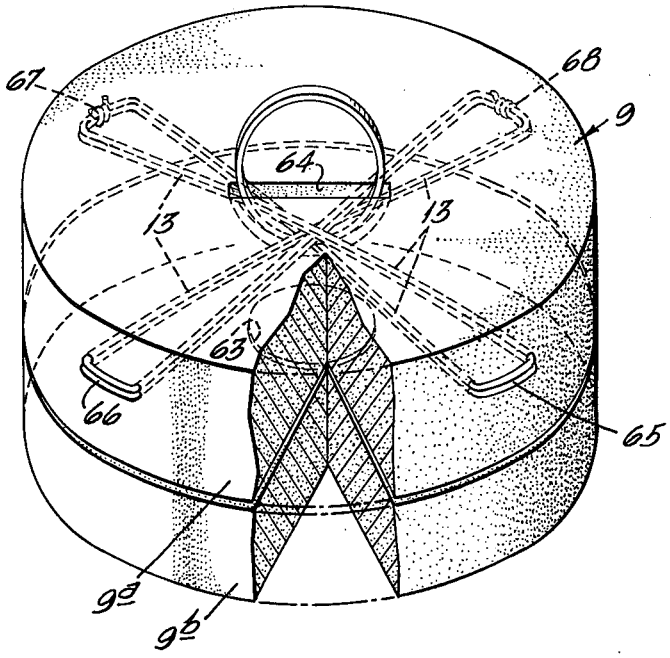
FIG. 1 is a general perspective view of a preferred disperser/diffuser member according to another embodiment of the invention.

Referring first to FIG. 1, numeral 1 denotes a subterranean storage tank, of the type customarily used at service stations for the storage of liquid fuel (gasoline). This tank is provided with the usual vent and discharge or dispensing (suction) lines (not shown), and is located below the surface or "grade" 2. A continuous fillpipe 3 (four inches in diameter, typically) extends substantially vertically downwardly from the surface 2 (actually, from a point slightly below the surface, within a so-called "ground box " 4), to the top of tank 1. Pipe 3 is sealed at 5 through the top of tank 1, and continues downwardly, substantially vertically, through the interior of the tank 1 to a point near to but spaced from the tank bottom 6 or tank floor. Typically, the lower end of pipe 3 may be spaced four inches above the tank bottom 6.

The tank 1 may be cylindrical in shape, 5-⅓ feet in diameter and 24 feet long, for example, with its longitudinal axis positioned substantially horizontally. These dimensions are given merely by way of example. Other tanks may be eight feet in diameter (these being larger tanks).

The upper end of pipe 3, slightly below the surface 2, is normally closed by a removable fill cap of conventional construction (not shown).

In subterranean storage tanks of the type described, which are used for the storage of liquid fuel (gasoline) at service stations, there is commonly present some water (termed "water bottoms") which exists as a layer 7 at the bottom 6 of the tank. The interface between the upper water layer and the gasoline thereabove is indicated by numeral *d*.

Figure 2:
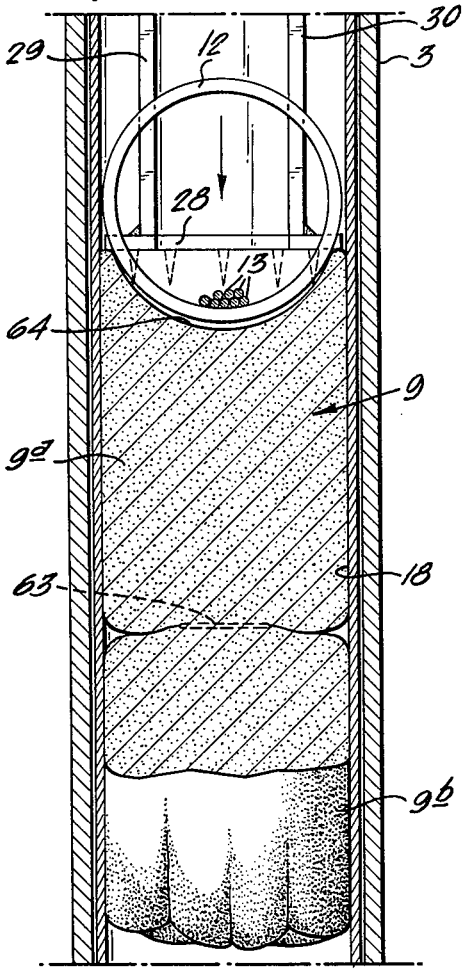
FIG. 2 is a sectional view showing the positioning of the preferred device of FIG. 1 in a fillpipe.

Refer now to FIGS. 2 and 6. According to a first embodiment of this invention, a disperser/diffuser member 9, formed as a cylindrical body about 12 inches in diameter and 4½ inches high, for example, is positioned between the lower end of fillpipe 3 and the tank bottom 6. The cylindrical body 9 is porous, with a quite high void-volume relationship (about 97%, for example). The body 9 has a reticulated skeletal structure (having, for example, ten pores per lineal inch), which thus provides a myraid (multiplicity) of slightly tortuous or labyrinthine passages for the flow of liquid therethrough. The body 9 is made of a material such as a polyurethane which is substantially unaffected by hydrocarbons such as gasoline, the material being foamed to provide the skeletal structure and porosity above described. Such foamed, highly porous, organic polymeric material is available commercially.

FIG. 6 illustrates the action of the disperser/diffuser member 9 (which may be thought of as a cylindrical pad) during a tank-filling operation. The member 9, being highly porous, permits the free passage of liquid therethrough. With the dimensions stated previously, the area of the cylindrical side wall of member 9, plus the area of the circular upper face thereof outside of the pipe 3, would be about 268.5 square inches, as contrasted to the pipe cross-sectional area (without member 9) of about 12.5 square inches. Thus, the member 9 offers a very large cross-sectional area for fluid flow (as compared to the cross-sectional area of the pipe 3 only, absent the pad).

The liquid flowing downwardly through pipe 3 during the tank-filling operation (indicated by the arrows within this pipe) is deflected by member 9 radically outwardly with respct to the pipe, and diffuses and disperses through the pad into the interior of the tank, as indicated by the arrows within the pad or member 9. Due to the very large cross-sectional area for fluid flow presented by the pad, as well as the slightly tortuous passages therein, the liquid diffuses from the member 9 and disperses into the tank at a velocity substantially less than the velocity at which it would enter into the tank from pipe 3, without the member 9. Moreover, the direction of flow through the pad is more or less parallel to the interface 8, and not at substantially 90° to this interface, as would be the case without member 9 (in which latter case the liquid would pour out of pipe 3 directly toward interface 8).

As a result of the above-described action of member 9, the water bottoms 7 are not disturbed, even in the slightest, during a tank-filling operation, and hence are not mixed into the fuel. This is in sharp contrast to the action which would occur if the disperser/diffuser member 9 were not present. In this latter case, the falling fuel, exiting from the lower end of the pipe 3 at a high velocity and in a direction substantially at 90° to the horizontal interface 8, would churn up or stir up the layer 7 of water, causing it to become mixed into the fuel thereabove. Although the water so churned up does eventually settle back down to its original position, it takes a considerable length of time (often twenty-four hours or more) to do so, and in the meantime some water (or other contaminant) could very likely be dispensed with the fuel.

The member 9, being porous with a very high void-volume relationship, is capable of being compressed (upon the application of an appropriate force) to an outer diameter on the order of four inches, such that it can pass through pipe 3. However, it has a "memory," such that when the constraint or force is released, it will return to its original dimensions (shown in FIG. 6).

The pad 9 is insertable into the tank 1, and is withdrawable therefrom, from the surface 2. Assume for the amount that the device 9 is in its operative position, illustrated in FIG. 6. The procedure and tool for inserting the same into the tank will be described later.

A retrorse cord arrangement, denoted generally by numeral 10, is secured to pad 9. This arrangement is operable to provide a retrorse action of the pad, to enable it to be withdrawn from the tank 1. The arrangement 10 includes a central loop 11 of cord which extends downwardly from one circular face of the pad (herein termed the top or upper face), close to the longitudinal axis thereof and in a longitudinal direction, and thence back upwardly. Both bights of the loop 11 extend through the interior of the pad to the center of the bottom or lower face thereof, and the two ends of this loop are secured to a retro or withdrawal metal ring 12 which is preferably just under four inches in diameter. Ring 12 is supported above the upper face of pad 9 by means of a rigid metal rod 13 which is integral with or welded to this ring and which extends downwardly from the ring and substantially axially through the pad 9, to a point adjacent the bottom face thereof. As illustrated, rod 13 may be located between the two bights of loop 11.

The retrose arrangement 19 also includes four side loops 14–17 of cord (spaced at 90° intervals with respect to the cylindrical outer surface of member 9) each of which has its two ends secured to the retro ring 12, and the bights of each of which extend downwardly from this ring, and thence downwardly and radially outwardly through pad 9, to locations near the outer periphery of the bottom circular face of the pad. It will be appreciated that, when an upward pull is applied by means of ring 12 to the cords 14–17, there will be a component of force which tends to pull the lower ends of these loops horizontally, that is, toward the axis of pad 9, and thus tends to in effect compress or fold this pad inwardly in the radial direction.

The side loops 14–17 are looser than the central loop 11, which is to say that the side loops have more slack than the central loop.

FIG. 6 illustrates the member 9, with its retrorse cord arrangement 10, in operative position, between the lower end of fillpipe 3 and the tank bottom 6. The height of pad 9 is slightly greater than the distance between the lower end of fillpipe 3 and the tank bottom 6, as shown in FIG. 6; this provides a frictional force between the upper face of the pad 9 and the pipe 3 which helps to maintain the pad in its proper position. When the pad is in operative position, ring 12 is established within pipe 3, about eight inches above the upper face of member 9, for example, and is held in this position by means of the rigid support 13.

When it is desired to retrieve or withdraw (i.e., remove) member 9 from tank 1, a suitable hook (not shown) is inserted into the upper end of fillpipe 3 at the surface 2, and lowered down through this pipe to engage the retro ring 12. An upward pull on the ring 12, by means of the aforesaid hook, first pulls the central area of the pad 9 upwardly by means of loop 11, in effect bowing the pad upwardly. A short time thereafter the side cords 14–17 come into play, to begin the retrorse action proper. These cords, due to the horizontal component of force acting on them as they are pulled upwardly, cause the pad to in effect bend backwardly and downwardly, this of course being aided by the continued upward movement of the center of the pad. This retrorse action compresses and folds the pad inwardly, in the radial direction, to a folded position somewhat as illustrated at 9F in FIG. 3. In such folded position, the member 9 fits into pipe 3, and may be drawn upwardly through this pipe (and out of tank 1 to the surface) by a continued upward pull on the withdrawal or retro ring 12.

It might be possible to eliminate the retrorse cord arrangement 10, and to retrieve or withdraw the member 9 from the tank 1 by lowering a set of mechanical fingers from the surface down through pipe 3 to grasp the pad 9 itself at the lower end of pipe 3; by then pulling fingers upwardly, it might be possible to fold the pad into pipe 3 and then draw such pad upwardly and out of the tank to the surface.

Refer now to FIG. 1 and 3–5, which illustrate a procedure and insertion tool by means of which the member 9 may be inserted into subterranean storage tank in situ, from the surface. A thin-walled cylindrical casing 18, having a diameter somewhat less than four inches, such that it can fit within pipe 3 and can move freely therein in a longitudinal direction, and having a length of about 16 inches for example, is open at its lower end and is rigidly secured at its upper end to a coupling member 19 which in turn is rigidly secured (as by welding, for example) to the lower end of an outer tubular member 20 within the bore of which is slidably mounted a central push rod 21. The member 20 and the rod 21 are elongated, having a length sufficient to extend from the lower portion of tank 1 through pipe 3 to the surface or "grade" 2, (for example, the distance between the lower end of casing 18, and the upper end of member 20 may be about twelve feet).

Near the upper end of member 20 (that is, the end opposite casing 18) there is provided an adjustable stop plate-support 22 which is slidably mounted on member 20 and which has an outer dimension somewhat greater than four inches, adapted to span the upper end of pipe 3. A collar 23 is secured to plate 22, and a locking screw or set screw 24, threaded into collar 23, bears against member 20 to secure the slidable combination 22-23 in an adjusted position on member 20. Thus, by bringing plate 22 into engagement with the upper end of pipe 3 and tightening screw 24, the member 20, and various elements carried thereby, may be held in a fixed position within pipe 3 (by preventing downward movement of member 20 within this pipe).

The plunger push rod 21 is somewhat longer than member 20, and at the upper end of member 20 there is provided a removable key or pin 25 which passes through a transverse hole in push rod 21 and bears against the upper end of member 20, thereby to prevent downward movement of push rod 21 in tubular member 20 (from its upper limiting position in member 20), except when the key 25 is removed.

A plunger, denoted generally by numeral 26, is secured to the lower end of push rod 21, this plunger being located within casing 18 and being slidable therein in response to a downward movement of the plunger push rod 21 with respect to tubular member 20. The plunger 26 has a generally tubular body portion 27 (see FIG. 5) which is secured at is upper end to push rod 21 and which carries at its lower end a horizontal foot plate 28 of somewhat larger diameter than body 27 (but smaller than the I.D. of casing 18). The foot plate 28 is in effect separated into two parts by two narrow, elongated, longitudinally-extending, diametrically-opposite slots 29 and 30 which extend upwardly from the lower end of body portion 27, but which terminate short of the upper end of this body portion (see FIG. 5).

Figure 3:
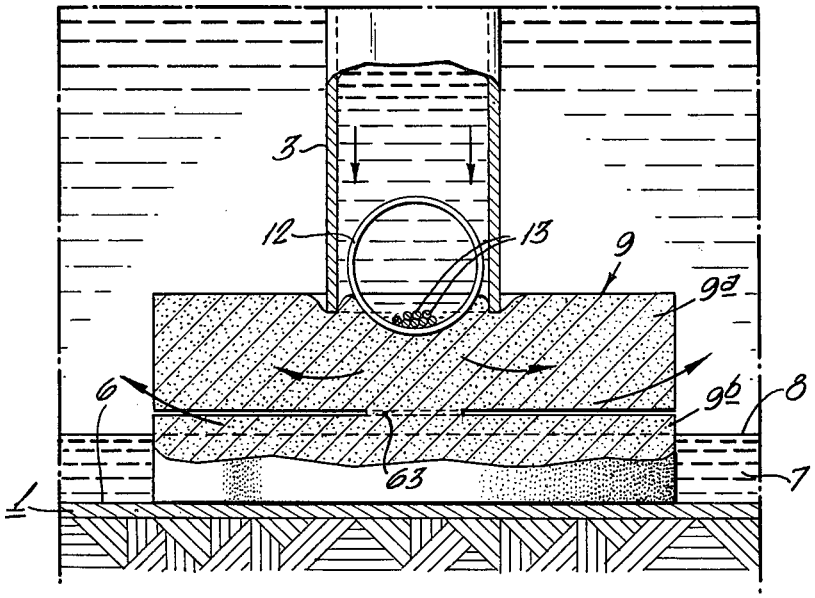
FIG. 3 is a sectional view showing the preferred device in position at the bottom of a fillpipe.

For insertion of member or pad 9 into the tank 1 from the surface, the insertion tool 18–30 described would be available at the surface, but would not at first be inserted into fillpipe 3. For insertion of the disperser/diffuser member 9 into its operative position in tank 1, the pad 9, with its retrorse cord arrangement 19, is compressed and folded into a position 9F (see FIG. 3, this position being similar to the retro position effected by the restrorse movement previously described, which takes place during withdrawal), and pushed into the lower end of casing 18 until the upper face of the pad 9F engages the foot plate 28 of plunger 26, as illustrated in FIG. 3. The foot plate 28 carries a plurality of downwardly-extending spikes 31 which "dig into" the pad 9F and help to retain it in position within the insertion tool, while it is being inserted into the tank. During loading (upward pushing) of the pad 9F into the casing 18 of the insertion tool, the retro ring 12 passes upwardly into the body portion 27 via the slots 29 and 30. It may be noted (see FIG. 3) that the pad at 9F, when properly loaded into the insertion tool, is contained entirely within casing 18. During pad loading, and during the initial part of the insertion procedure, the plunger 26 is in its uppermost position within casing 18 (upper end face of body 27 in engagement with lower end face of coupling member 19), and pin 25 is inserted into rod 21 and in the engagement with the upper end of member 20.

After the pad has been loaded at 9F into the insertion tool, the cover or closure is removed from the upper end of the fillpipe 3, and the complete insertion tool assembly 18–31 is pushed downwardly (by means of member 20) through the fillpipe, the casing 18 end first. During passage down through the fillpipe, the pad 9F remains within the casing 18, as illustrated in FIG. 3 (since pin 25 prevents any downward movement of plunger 26 with respect to casing 18 at this time).

The insertion tool is pushed downwardly through fillpipe 3 until the lower end of the casing 18 contacts the tank bottom 6, following which the entire assembly is raised four inches off the bottom (this being the distance between the tank bottom and the lower end of fillpipe 3). When the insertion tool assembly has been thus properly positioned, member 20 and casing 18 are fixed in this position by sliding stop plate 22 downwardly on member 20 until this plate contacts the upper end of pipe 3, and then tightening the screw 24 into rigid engagement with member 20. At this stage in the procedure, the elements have the positions illustrated in FIG. 1.

Next, pin 25 is withdrawn or removed from push rod 21, and then the plunger push rod 21 is pushed downwardly, causing plunger 26 to move downwardly within casing 18 (the latter being held fixed in position). The downward movement of the plunger stop plate 28 pushes the pad or member 9F downwardly through casing 18 and out the open lower end thereof, which allows the pad 9 to expand or "bloom" outwardly into the full-diameter position illustrated in phantom lines in FIGS. 1 and 3, which latter position is its "released" or operative position, between the lower end of fillpipe 3 and the tank bottom 6.

When insertion of the pad into the tank 1 has been completed by pushing the pad completely out of the casing 18 as described, the entire insertion tool assembly 18–31 is withdrawn upwardly through the fillpipe 3, the pad 9 remaining in its operative position at the lower end of fillpipe 3, as illustrated in FIG. 6.

There has been described previously a first embodiment of the invention, wherein the disperser/diffuser member forms part of a filling arrangement for a subterranean fluid storage container (tank), and wherein such member (in the form of a pad 9) is insertable into the tank, and withdrawable, from the surface. There will now be described another embodiment of the invention, wherein the disperser/diffuser member forms part of a bottom fillpipe or bottom loading arrangement for a mobile fluid storage and transportation container (e.g., a tank truck).

First referring to FIG. 7, which shows a conventional arrangement, a portion of the bottom wall of one of the compartments of a multi-compartment tank truck is illustrated at 32, this bottom wall having a depressed central portion or area 33 which provides sump. The sump 33 has a centrally-located hole 34 therein, and a rigid mounting plate 35 is firmly secured to the bottom of the sump at hole 34. The substantially horizontal mounting plate 35 has a central aperture therein, and in this aperture is sealed (on the outer or lower side of plate 35) one end of a loading and discharging fitting 36, illustrated as a pipe elbow. A coupling 37, for example of the so-called quick-disconnect type, is sealed to the the other end of fitting 36, for attaching a hose 50 (used for loading of the tank truck compartment and also for unloading thereof) to the fitting 36. The arrangement 50, 37, 36, etc. provides a tight-fill connection for bottom loading.

The lower end of a valve housing 38 is sealed to the inner or upper side of plate 35 at the aperture therein, this housing having a cylindrical fluid passage 39 whose lower end thus can communicate with the fluid passage in fitting 36. The valve housing 38 has mounted therein an imperforate valve disc or plate 40 which is adapted to seal against a seat (not shown) provided at the lower end of passage 39 (or, essentially, at the upper end of fitting 36), but this plate is adapted to be moved upwardly, away from its seat (thus to place passage 39 in communication with fitting 36), against the bias provided by a spring 41. The cylindrical passage 39 inside valve housing 38 opens to the interior of the tank truck compartment by way of a plurality of openings or ports 42 (there being four openins 42, centered at 90° intervals around the circumference of housing 38) provided in the wall of housing 38, so that when the valve disc 40 is displaced from its seat, the fitting 36 communicates with the interior of the tank truck compartment by way of passage 39 and openings 42. It may be noted that the disc 40 is illustrated in its closed or sealed position in FIG. 7.

For operating the valve disc 40, a push rod 43 is secured at its upper end to the lower face of this disc, this rod extending through plate 35, within the fitting 36. An arm 44, having at one end thereof a camming element 45 which is adapted to engage the lower end of rod 43, so secured at its other end to a rotatable shaft 46 which is rotatably sealed through the wall of fitting 36. one end of a valve operating arm 47 is secured to the outer end of shaft 46, and one end of a link member 48 is pivotally secured near the end of this arm. One end of a valve operating cable 49 is attached to the free end of link 48, this cable extending through a flexible bellows arrangement 51 to a remote manually-operable valve lever (not shown). When the valve lever is operated to pull cable 49 toward the right in FIGS. 7 and 8, arm 47 and shaft 46 will be rotated in the counterclockwise direction, rotating arm 44 in the counterclockwise direction also and pushing the rod 43 upwardly to lift disc 40 away from its seat (against the bias of the return or valve-closing spring 41) to open the valve.

A rod 52 passes slidably through the center of the helical spring 41, this rod being secured at its lower end to the upper face of disc 40. Rod 52 passes slidably through a collar 53 which is secured to the fixed or stationary valve housing 38 and extends upwardly therefrom. The lower end of a push rod 54 has formed thereon a hook 55 which is adapted to pass through and hook into an eye threadably secured to the upper end of rod 52. Push rod 54 extends upwardly to an emergency vent valve (not Shown) provided at the top of the tank compartment. Rod 54 is pushed upwardly (to open the emergency vent valve) by rod 52 when the valve disc 40 is lifted off its seat; thus, the emergency vent valve is necessarily opened whenever fuel flows into or out of the tank compartment. This provides a safety feature, which positively prevents damage to the tank at such time.

To fill or load the tank truck compartment, fluid (e.g., liquid fuel) is pumped through the hose 50 and fitting 36 toward the tank, in the direction by arrow 56, at a high flow rate (on the order of 500–550 gallons per minute), which means that this fluid possesses a substantial amount of kinetic energy. (Of course, the valve disc 40 is lifted away from its seat when the tank is to be bottom loaded as described). The initial flow of fuel into the empty tank compartment from the bottom, through the openings 42, is quite violent, as indicated by the various swirling lines 57 in FIG. 7. The fuel squirts all over the compartment, and a good deal of it is actually vaporized. This high flow rate has even been known to cause structural damage to the tank. To reduce this effect a little, using the conventional arrangement (FIG. 7) the initial flow rate is reduced, by means of a relatively expensive two-speed control valve in housing 38, until there is an adequate head of liquid inside the tank to absorb the high kinetic energy of the liquid under full flow conditions. Even after this time, however, when the flow rate in is increased to full, the liquid continues to churn and swirl around quite violently, with substantial vaporization of the fuel. Since the initial flow rate must thus be reduced when using the conventional bottom-loading arrangement (FIG. 7), the average filling rate or loading rate is slowed.

Referring now to FIG. 8, which illustrates a bottom loading arrangement according to the invention. An essentially doughnut-shaped disperser/diffuser member or ring 9', made of the same highly porous or foamed material as pad 9, described hereinabove, is mounted around the outside of the bottom (loading and discharge) valve housing 38. Member 9' is preferably in the form of a cylinder with a longitudinal central bore (sized to fit rather closely around the outside of housing 38), and may be, for example, approximately twelve inches in diameter and 6½ inches in height. The bottom of member 9' fits tightly against the compartment bottom wall 32, and the diameter of this member is sufficiently greater than that of the sump 33 to preclude any fluid from flowing out of the valve ports or openings 42 into the tank truck compartment without first passing through the fluid passages in member 9'.

The member 9' may be easily installed in each compartment of the bottom-loaded tank truck by way of the manholes at the top of the compartments. Member 9' is held in position by means of a circular (twelve inches in diameter) hold-down plate 58 which firmly engages the upper surface of this member, plate 58 having a relatively small central opening 59 (adapted to loosely surround rod 52) but being otherwise imperforate. Plate 58 has fixed thereto, at its center, a downwardly-extending sleeve 60 provided with integral hooks at its lower end which are adapted to hook over radially-outwardly-extending pins 61 secured to the stationary collar 53. For installation of member 9', rod 54 may be unhooked and removed from rod 52, along with the eye into which hook 55 hooks, and then, after member 9' is placed in position, plate 58 may be placed on top of member 9' and hooked to collar 53. Push rod 54 is then returned to its operating position.

With the ring 9' in place as described, the fluid must pass through this highly porous material on its way from the valve ports 42 to the interior of the tank or compartment. The fluid flow through the member 9' is mainly in a radial direction. The ring 9' absorbs a large portion of the kinetic energy of the fluid by dispersing it through the multiplicity of myriad of tortuous or labyrinthine fluid passages in the porous, foamed material of the ring. By this breaking up the fluid flow into many directions, it is caused to diffuse from the foam in a smooth, even, or calm manner, as indicated in FIG. 8 by the arrows 62. There is a minimum of violent action, in sharp contrast to the action in FIG. 7 (without the member 9').

Using the disperser/diffuser member 9', fluid can be pumped at the full flow rate, even into an empty tank. So, a less expensive, one-speed control valve can be used, and fastener loading can be achieved; the flow rate of fuel into the tank is not measurably reduced by the presence of member 9' in the fluid flow path.

The same hose 50 and fitting 36 and valve 38 are used for gravity flow out of the tank, for example into the subterranean storage tank previously described in connection with FIGS. 1–6, as indicated by the double-ended arrow 56' (FIG. 8). It has been found that the foam ring 9', since it is 97% void, does not reduce by a measurable amount the discharge rate out of the tank. For example, the discharge rates both with and without the member 9' were found to be about 200 gallons per minute.

Since the fluid flow out of the member 9' is so smooth, even and non-violent, vaporization of the liquid fuel is greatly reduced, thus reducing air pollution.

The member 9' is rather inexpensive.

Although the second embodiment of the invention has been described in connection with the bottom loading of gasoline into tank trucks, it is also applicable to fuel oils, and in fact it would probably be even more advantageous for such latter fluids, since they foam quite readily. That is to say, the disperser/diffuser member 9' would greatly reduce the production of foam during bottom loading of fuel oils.

The member 9' has been described in connection with tank trucks, but it would also be applicable to many other types of tanks, for bottom loading.

The invention is illustrated in FIG. 1 which shows in perspective a preferred form of the porous disperser/-diffuser body designated generally by numeral 9. In this embodiment the porous body 9 is cut or sliced peripherally and parallel to its face to form two bodies, an upper section **9*a* and a lower section 9*b*. Each of these sections, 9*a* and 9*b*, is of essentially equal size and since the peripheral slice does not penetrate the porous body completely the two sections remain joined together at the bottom of section 9*a* and the top of section 9*b* as shown at 63. A retrorse cord arrangement is secured to the upper portion 9*a* of porous pad 9 and comprises a plurality of cords 13 looped around or otherwise fastened to a withdrawal device, shown as a ring 12, which may be partially imbedded in a slot 64. The retrorse cords extend from the withdrawal device 12 in an essentially equally spaced apart relationship to the periphery of the porous body where the cords are looped, as shown at 65 and 66 and or fastened by knotting as shown at 67 and 68**.

The porous body as just described is a preferred embodiment because it facilitates its placement within the thin-walled cylindrical casing 18. When inserting the porous body 9 in the lower end of casing 18, its upper portion **9*a* is folded upwardly and compressed and then positioned in the casing. At it is pushed into the casing, the lower section 9*b* is folded downwardly and compressed as insertion occurs. Thus, as shown in FIG. 2, the porous body is partially separated into two compressed sections; an upper section 9*a* and a lower section 9*b*, but the pad remains joined at its center 63. FIG. 3 illustrates the position of the pad after being pushed through the casing at the bottom of the tank and the casing removed where it is seen that the pad expands outwardly into the full-diameter operative position. Withdrawal of the pad when desired is accomplished as described above and this procedure is also aided by the preferred two sectioned pad 9** since folding and compression occurs more readily because of the peripheral cut.

The invention claimed is:

1. As an article of manufacture, a cylindrical body able to be passed through a fillpipe, said body made of material which is substantially unaffected by hydrocarbons, said body being porous and having a high void-volume relationship, and a retrorse cord arrangement fastened to said body, wherein said porous body is peripherally sliced parallel to its tp and bottom to form an upper and a lower body of essentially equal size joined at the center and said retrorse cord comprises a plurality of cords connected to a withdrawal device at the center of the face of said upper body and said cords extend through said upper body in an essentially equally spaced apart relationship and are attached to the outer peripheral wall of said upper body.

2. Article of claim 1 wherein said body is made of a polyurethane and has a void-volume relationship in excess of 90%.

3. Article of claim 1, wherein said body comprises a pad made from a polyurethane foam.

* * * * *